US008306231B2

(12) United States Patent
Gustavsson et al.

(10) Patent No.: US 8,306,231 B2
(45) Date of Patent: Nov. 6, 2012

(54) PORTABLE DEVICE WITH ENHANCED STEREO IMAGE

(75) Inventors: Stefan Gustavsson, Helsingborg (SE); Markus Mimer, Stockholm (SE); Dag Glebe, Lund (SE)

(73) Assignee: Sony Mobile Communications AB, Lund (SE)

( * ) Notice: Subject to any disclaimer, the term of this patent is extended or adjusted under 35 U.S.C. 154(b) by 1047 days.

(21) Appl. No.: 11/817,159

(22) PCT Filed: Feb. 28, 2006

(86) PCT No.: PCT/EP2006/060332

§ 371 (c)(1),
(2), (4) Date: Sep. 4, 2008

(87) PCT Pub. No.: WO2006/089969

PCT Pub. Date: Aug. 31, 2006

(65) Prior Publication Data

US 2009/0003610 A1 Jan. 1, 2009

(30) Foreign Application Priority Data

Feb. 28, 2005 (EP) ..... 05101507

(51) Int. Cl.
*H04R 5/00* (2006.01)

(52) U.S. Cl. ..... 381/1; 381/17

(58) Field of Classification Search ..... 381/17, 381/18, 1; 455/575.1, 350, 416; 345/156
See application file for complete search history.

(56) References Cited

U.S. PATENT DOCUMENTS

| | | | | |
|---|---|---|---|---|
| 4,058,675 | A | 11/1977 | Kobayashi et al. | |
| 5,146,507 | A * | 9/1992 | Satoh et al. | 381/103 |
| 5,305,386 | A * | 4/1994 | Yamato | 381/1 |
| 5,796,845 | A * | 8/1998 | Serikawa et al. | 381/18 |
| 6,804,358 | B1 * | 10/2004 | Kawano | 381/17 |
| 6,882,335 | B2 * | 4/2005 | Saarinen | 345/156 |
| 7,047,052 | B2 * | 5/2006 | Akai et al. | 455/575.1 |
| 7,702,320 | B2 * | 4/2010 | Komura | 455/416 |

FOREIGN PATENT DOCUMENTS

| | | |
|---|---|---|
| EP | 1 225 789 | 7/2002 |
| EP | 1225789 | 7/2002 |

OTHER PUBLICATIONS

International Search Report for corresponding Application No. PCT/EP2006/060332 mailed May 12, 2006.
Chinese Office Action for corresponding application No. 200680006310.8 issued May 8, 2009.

* cited by examiner

*Primary Examiner* — Devona E. Faulk
*Assistant Examiner* — David Ton
(74) *Attorney, Agent, or Firm* — Renner, Otto, Boisselle & Sklar, LLP

(57) ABSTRACT

The invention relates to a portable device with an enhanced stereo image, and more particularly a device in which an unsymmetrical placement of loudspeakers is compensated by means of electronic adjustment of the phase and level of the sound. The present invention provides a device (1) comprising a sound source outputting audio channels in stereo, a sound reproduction system delivering electronic sound signals based on the audio channels to at least two loudspeakers (2, 3) for sound reproduction with a stereo image. The device further comprises means for adjusting the level and phase of one of the sound signals to one loudspeaker (2).

17 Claims, 1 Drawing Sheet

PORTABLE DEVICE WITH ENHANCED STEREO IMAGE

FIELD OF THE INVENTION

The present invention relates to a portable device with an enhanced stereo image, and more particularly a device in which an unsymmetrical placement of loudspeakers is compensated by means of electronic adjustment of the phase and level of the sound.

STATE OF THE ART

Portable devices, e.g. mobile telephones, may have several speakers enabling sound reproduction in stereo, i.e. left and right channels reproduced by different loudspeakers which gives a more natural sound. However, in small portable devices it is not always possible to place the loudspeakers symmetrically. Sometimes the loudspeakers are not even of the same kind and not pointing in the same direction. This causes the stereo image to be unsymmetrical and poor.

In the past, the stereo image has been improved by using an equaliser making the frequency responses equal in the user's ears from the two speakers. The problem is that the stereo image will still be unsymmetrical as only the frequency response is corrected.

SUMMARY OF THE INVENTION

The present invention provides an even further improved stereo image by compensating both the frequency response, i.e. the level at various frequencies, and phase differences between a symmetrical placement and the actual placement of the loudspeakers.

The present invention provides a device comprising a sound source outputting audio channels in stereo, a sound reproduction system delivering electronic sound signals based on the audio channels to at least two loudspeakers for sound reproduction with a stereo image.

According to the invention, the device comprises means for adjusting the level and phase of one of the sound signals to one loudspeaker, the adjusting means being adapted to enhance the stereo image.

In one embodiment, the adjusting means is adapted to make the two loudspeakers to appear symmetrically placed with reference to a line in a plane parallel to a graphical user interface of the device and midway between the two loudspeakers.

Suitably, the line is also parallel to one side of the device.

Preferably, the graphical user interface and the resulting stereo image are adapted to depend on an operation mode of the device.

Suitably, the adjusting means is adapted to adjust the sound signal so that the one loudspeaker obtains a similar frequency response at a position placed symmetrically with reference to the other loudspeaker.

The adjusting means may be adapted to adjust the sound signal so that the stereo image is optimised at a presumed listener's position.

Suitably, the adjusting means is adapted to operate within a frequency range in which the loudspeakers have a similar frequency response.

In one embodiment, the adjusting means is adapted to operate within a frequency range of 150 Hz to 15 kHz.

In another embodiment, the adjusting means is adapted to operate within a frequency range of 1 kHz to 8 kHz.

Preferably, the adjusting means is a filter.

The filter may be a digital infinite impulse response (IIR) filter, or a finite impulse response (FIR) filter, or an analog filter.

Suitably, the adjusting means is located in the audio channel connected to the loudspeaker having the best performance.

The device may be a portable telephone, a pager, a communicator, a smart phone, or an electronic organiser.

BRIEF DESCRIPTION OF THE DRAWINGS

The invention will be described in detail below with reference to the accompanying drawings, in which.

DETAILED DESCRIPTION OF PREFERRED EMBODIMENTS

The present invention will be described with reference to a mobile telephone. The invention is equally applicable in other portable devices such as pagers, communicators, smart phones and electronic organisers etc. Besides the normal function as e.g. a telephone, the device also is a portable device for playing music and/or videos and a game device, all of which use sounds for providing audio information. As is known, the listening experience may be enhanced by using stereo, i.e. different left and rights audio channels, or even more advanced sound systems giving the sound an appearance of space. Various systems with widened stereo and surround sound have been known for some time. The present invention does not relate to the method of how to achieve the stereo signals per se.

There are many types of designs for mobile telephones, such as the one piece stick type, the foldable clam shell type and jack knife type with various hinges and connections. All designs have different advantages depending on the actual operating mode of the telephone and user preferences. Due to lack of space inside the phone, it is often not possible to place loudspeakers in a symmetrical way, which would give the best stereo image. The loudspeakers may also have different functions depending on the operation mode of the telephone. Also, for economical reasons one of the loudspeakers may be less sophisticated, having a poorer frequency response.

Figure 1A:
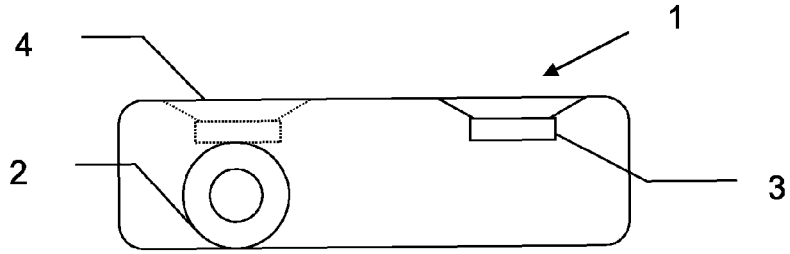
FIG. 1A is a side view of a portable device having two unsymmetrically placed loudspeakers according to the invention.
Figure 1B:
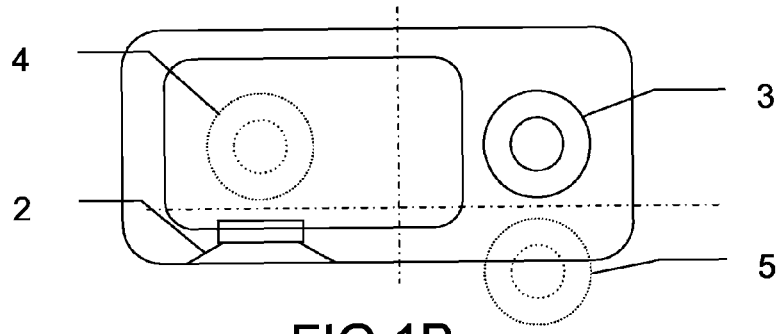
FIG. 1B is a front view of the device in FIG. 1A.

As an illustrating example, FIGS. 1A and 1B show a stick phone 1 from the side and the front, respectively. For clarity, only components relevant to the present invention are shown. The front is the broader side having a display 6. The device is provided with two loudspeakers, one speaker 2 on the side pointing sideways and another speaker 3 on the front surface. Since the speakers are separated a distance, it gives the possibility to provide sound in stereo.

However, the speakers are not ideally placed. For instance in one operation mode the device is held horizontal, such as when viewing a video sequence. The control system of the device makes sure that graphical user interface GUI orientates the image on the display 6 correctly. In this case the loudspeaker 2, delivering the left channel, would ideally be placed as a speaker 4 shown with phantom lines. In other words, the loudspeakers are symmetrically placed with reference to a line in a plane parallel to a graphical user interface of the device and midway between the two loudspeakers. The line is also parallel to the short side of the device.

In another example, such as when listening to music only, the display 6 may show a play list with the device held in a vertical position. Then the loudspeaker 2 would ideally be placed as a speaker 5 shown with phantom lines. In other words, the loudspeakers are symmetrically placed with reference to another line in a plane parallel to a graphical user interface of the device and midway between the two loudspeakers. The line is also parallel to the long side of the device.

Stated briefly, the present invention adjusts the sound signal delivered to one of speakers so that the loudspeakers appear to be placed symmetrically. The symmetrical placement may depend on the actual operation mode of the device.

It is not necessary to make adjustments of the whole frequency spectrum. As is known, not the whole frequency spectrum has a noticeable impact on the stereo image. Low frequencies have low directivity and need not be played with a specifically directed speaker. (Preferably, the speaker with the best base sound reproduction is used.) On the other hand, high frequencies have small wavelengths. For instance, frequencies above 10 kHz have wavelengths around 3 centimetres and smaller. The wavelengths thus approach the distance between the loudspeakers and it is difficult to control the stereo image, which also will be very dependent on the location of the listener relative to the speaker system.

Also, speakers in mobile phones have limitations with respect to performance. They are mainly designed to reproduce speech, at least originally, and often have a good sound reproduction only between 1 kHz and 8 kHz.

Figure 2:
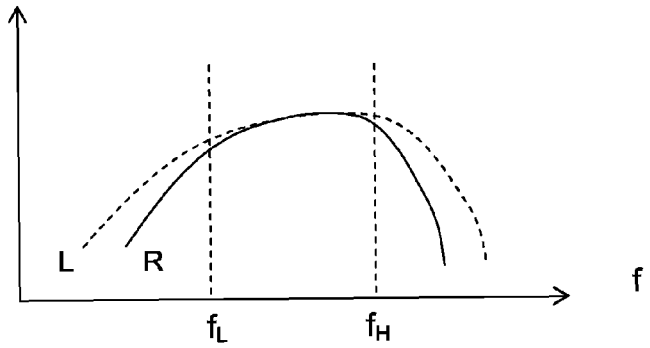
FIG. 2 is a diagram of the frequency responses of two loudspeakers.

FIG. 2 shows a diagram of typical frequency responses of two different loudspeakers. In this example, the left dashed line L represents the left loudspeaker 2 and the solid line R represents the right loudspeaker 3. According to the invention, it is only useful to treat sound signals within a range from $f_L$ to $f_H$, where both loudspeakers have a good and similar response. When setting the limits one should also take into account the general discussion of the limits within which it is meaningful to try to create a stereo image. It should also be born in mind that if a loudspeaker is caused to compensate for a poor frequency response, this may result in increased distortion and noise. The limits $f_L$ and $f_H$ may also depend on the operation mode of the device. For two good loudspeakers the compensated range may be from 50 Hz to 15 kHz. For two normal phone loudspeakers the compensated range is suitably from 1 kHz to 8 kHz.

Figure 3:
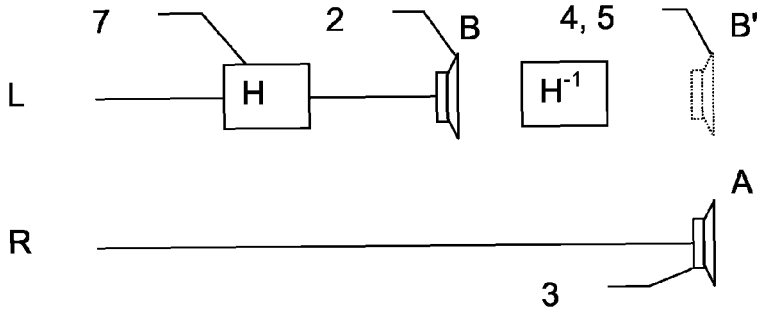
FIG. 3 is a schematic view showing a filter in one audio channel according to the invention.

FIG. 3 shows an example on how to achieve the compensation in accordance with one embodiment of the invention. An electronic component is located in one of the audio channels, e.g. an amplifier or a filter 7 having different amplification or attenuation including phase shift that may be set for different frequencies. Preferably, the component 7 is located in the audio channel connected to the loudspeaker with the best performance.

Two electronic sound signals left L and right R are delivered to the speakers 2 and 3, giving rise to measurable sound levels B and A, respectively. The sound levels A and B are thought to exist at the outlet of each speaker. However, at the imaginary speaker 4 or 5 there is another sound level B'. Depending on the geometry of the device 1 this sound B' differs from B. Now it is desired that the sound B' should exactly equal the sound A. By measuring the sound A at the speaker 3 and the sound B' at the corresponding location of an imaginary speaker 4 or 5, and using a difference impulse response, a transfer function $H^{-1}$ may be calculated. To achieve equality between A and B', the filter 7 is set to the inverse of $H^{-1}$, i.e. H. Thus, B=HA.

It is also possible to measure the sound at the outlet of speaker 2, i.e. the sound level B. Then the transfer function of filter 7 would of course still be $$H = \frac{B}{A}.$$

The transfer function H of the filter 7 may also be measured by measuring at a presumed listener's position in accordance with the various operation modes of the device 1.

The electronic component 7 is suitably a digital filter. An infinite impulse response, IIR, filter gives the most flexibility but is also expensive. A finite impulse response, FIR, filter is adequate in most situations. Also analog filters may be used if the transfer function H is not too complex.

The placement of the imaginary left speaker 4 or 5 may be set automatically in dependence of the GUI by the control unit of the device. For instance, if the device is used for showing video or gaming the position at 4 is used, and when using the device for playing back music the position at 5 is used. Depending on the operation mode also a presumption can be made about the listener's position and the stereo image and compensation in one audio channel is set accordingly. It should also be possible to set the transfer function manually in dependence of the listener's desired positions.

The invention is also applicable to stereo microphones. In this case, the loudspeakers 2 and 3 are replaced by microphones (not shown) that may be placed unsymmetrically. An electronic component is placed in one audio channel to compensate for level and phase differences between a symmetric placement and the actual asymmetric placement, just as in the case for loudspeakers. In this way, an enhanced stereophonic recording may be made. Also, such an arrangement can be used in a conference call situation, using a phone in loudspeaker mode at the other end reproducing sound in stereo.

The invention results in a better perceived stereo image. If wide stereo is used as the electronic sound signals L and R a better stereo widening effect is obtained. The scope of the invention is only limited by the claims below.

The invention claimed is:

1. A device comprising a sound source outputting audio channels in stereo, a sound reproduction system delivering electronic sound signals based on the audio channels to at least a first and a second loudspeaker for sound reproduction with a stereo image, wherein one of the first and second loudspeakers is positioned asymmetrically with reference to the other of the first and second loudspeaker on the device, wherein said first and second loudspeakers are facing different directions, and one of the first and second loudspeakers having a different frequency response than the other, the device further comprising an adjusting device for adjusting the level and phase of the sound signals to one of the first and second loudspeakers, wherein the adjusting device is adapted to make one of the first and second loudspeakers appear symmetrically placed with reference to the other of the first and second loudspeaker, and to adjust the sound signal based on operation mode so that one of the first and second loudspeakers obtains a similar frequency response at an imaginary position placed symmetrically with reference to the other of the first and second loudspeaker.

2. The device according to claim 1, wherein the adjusting device is adapted to make the first and second loudspeakers appear symmetrically placed with reference to an imaginary line in a plane parallel to a graphical user interface of the device and midway between the first and second loudspeakers.

3. The device according to claim 2, wherein the imaginary line is also parallel to one side of the device.

4. The device according to claim 2, wherein the orientation of the image on the graphical user interface and the resulting stereo image are adapted to depend on an operation mode of the device.

5. The device according to claim 2, wherein the adjusting device is adapted to adjust the sound signal so that the stereo image is optimised at a presumed listener's position.

6. The device according to claim 1, wherein the adjusting device is adapted to operate within a frequency range in which the first and second loudspeakers have a similar frequency response.

7. The device according to claim 1, wherein the adjusting device is adapted to operate within a frequency range of 150 Hz to 15 kHz.

8. The device according to claim 1, wherein the adjusting device is adapted to operate within a frequency range of 1 kHz to 8 kHz.

9. The device according to claim 1, wherein the adjusting device is a filter.

10. The device according to claim 9, wherein the filter is a digital infinite impulse response (IIR) filter, or a finite impulse response (FIR) filter, or an analog filter.

11. The device according to claim 1, wherein the adjusting device is located in the audio channel connected to the loudspeaker having the best performance based on the frequency response.

12. The device according to claim 1, wherein the device is a portable telephone, a pager, a communicator, a smart phone, or an electronic organiser.

13. The device according to claim 1, wherein the device has a front surface, a back surface, and a plurality of side surfaces, and wherein at least one of the at least first and second loudspeakers is disposed on the front surface and at least one of the at least first and second loudspeakers is disposed on one of the plurality of side surfaces.

14. The device according to claim 13, wherein the device is a portable electronic device.

15. The device according to claim 1, wherein the first and second loudspeakers are physically arranged asymmetrically with respect to an imaginary line perpendicular to or parallel to an axis of the device, and when adapted by the adjusting device, a location of one of the first or second loudspeakers appears symmetric to the imaginary line.

16. The device according to claim 15, wherein when the device is in a horizontal position the adjusting device adapts one of the first and second loudspeakers so that the loudspeakers appear to be symmetric with respect to a first vertical imaginary line and when in a vertical position the adjusting device adapts the other of the first and second loudspeakers so that the loudspeakers appear to be symmetric with respect to a second vertical imaginary line.

17. The device according to claim 1, wherein the adjusting device is configured to adjust the sound of at least one of the first and second loudspeakers so that the loudspeakers appear to be horizontally separated in both a vertical position of the device and a horizontal position of the device.

* * * * *